US009726105B2

(12) United States Patent
Ulrey et al.

(10) Patent No.: US 9,726,105 B2
(45) Date of Patent: Aug. 8, 2017

(54) SYSTEMS AND METHODS FOR SENSING FUEL VAPOR PRESSURE

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US); Pankaj Kumar, Dearborn, MI (US); Imad Hassan Makki, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 332 days.

(21) Appl. No.: 14/558,406

(22) Filed: Dec. 2, 2014

(65) Prior Publication Data

US 2016/0153384 A1 Jun. 2, 2016

(51) Int. Cl.
*F02D 41/30* (2006.01)
*F02D 41/06* (2006.01)
*F02D 41/38* (2006.01)

(52) U.S. Cl.
CPC ..... *F02D 41/3082* (2013.01); *F02D 41/064* (2013.01); *F02D 41/3854* (2013.01); *F02D 2200/0602* (2013.01); *F02D 2200/0604* (2013.01); *F02D 2200/0606* (2013.01); *F02D 2200/0612* (2013.01); *F02D 2250/02* (2013.01)

(58) Field of Classification Search
CPC ..... F02D 41/3082; F02D 2200/0602; F02D 2200/0604; F02D 2200/0612
USPC ..... 73/114.49, 114.43
See application file for complete search history.

(56) References Cited

U.S. PATENT DOCUMENTS

| | | | | |
|---|---|---|---|---|
| 3,822,677 | A | 7/1974 | Reddy | |
| 3,967,598 | A | 7/1976 | Rachel | |
| 5,477,833 | A | 12/1995 | Leighton | |
| 5,878,727 | A | 3/1999 | Huls | |
| 5,884,610 | A | 3/1999 | Reddy | |
| 5,937,826 | A | 8/1999 | Olson et al. | |
| 6,024,064 | A | 2/2000 | Kato et al. | |
| 6,053,036 | A * | 4/2000 | Uto | F02D 41/0042 701/103 |

(Continued)

FOREIGN PATENT DOCUMENTS

| | | |
|---|---|---|
| EP | 2434137 B1 | 7/2013 |
| WO | 2014031400 A1 | 2/2014 |

OTHER PUBLICATIONS

Pursifull, Ross D., "System and Method for Operating an Engine Combusting Liquefied Petroleum Gas," U.S. Appl. No. 13/970,519, filed Aug. 19, 2013, 30 pages.

(Continued)

*Primary Examiner* — Erick Solis
(74) *Attorney, Agent, or Firm* — Julia Voutyras; McCoy Russell LLP

(57) ABSTRACT

Systems and methods for sensing fuel vapor pressure are provided. In one example, a method for a vehicle comprises: during an engine start after the engine has been off for at least a minimum duration, actively controlling fuel pressure in the fuel system to a vapor-liquid volume ratio greater than zero and then recording sensed fuel pressure and temperature in the fuel system. In this way, the vapor pressure of a fuel at a given temperature may be accurately measured during isothermal conditions, thereby improving an estimation of fuel volatility.

18 Claims, 6 Drawing Sheets

(56) References Cited

U.S. PATENT DOCUMENTS

| | | | | |
|---|---|---|---|---|
| 6,138,638 | A | 10/2000 | Morikawa | |
| 6,142,747 | A | 11/2000 | Rosenau et al. | |
| 6,196,203 | B1 | 3/2001 | Grieve et al. | |
| 6,499,476 | B1 * | 12/2002 | Reddy | F02D 41/0045 123/520 |
| 6,679,225 | B2 * | 1/2004 | Robertson | F02D 19/0631 123/436 |
| 6,694,950 | B2 | 2/2004 | Djordjevic | |
| 6,854,321 | B2 | 2/2005 | Amlin | |
| 6,964,262 | B2 | 11/2005 | Hayakawa | |
| 6,988,488 | B2 | 1/2006 | Pursifull et al. | |
| 7,025,050 | B2 | 4/2006 | Oono et al. | |
| 7,059,313 | B2 | 6/2006 | Lippa | |
| 7,128,057 | B2 | 10/2006 | Wiese et al. | |
| 7,272,485 | B2 | 9/2007 | Amano et al. | |
| 7,640,916 | B2 | 1/2010 | Ulrey et al. | |
| 7,759,010 | B2 | 7/2010 | Hoch | |
| 7,832,375 | B2 | 11/2010 | Dusa et al. | |
| 7,886,720 | B2 | 2/2011 | Graf | |
| 8,061,329 | B2 | 11/2011 | Pursifull et al. | |
| 8,483,932 | B2 | 7/2013 | Pursifull | |
| 8,776,764 | B2 | 7/2014 | Basmaji et al. | |
| 2001/0029925 | A1 | 10/2001 | Ferry et al. | |
| 2002/0170539 | A1 | 11/2002 | Rembold et al. | |
| 2005/0257779 | A1 | 11/2005 | Knight et al. | |
| 2009/0090331 | A1 | 4/2009 | Pursifull | |
| 2010/0332108 | A1 | 12/2010 | Kato et al. | |
| 2011/0106393 | A1 | 5/2011 | Pursifull | |
| 2011/0209687 | A1 | 9/2011 | Schroeder et al. | |
| 2013/0061830 | A1 | 3/2013 | Hornby et al. | |
| 2013/0138325 | A1 | 5/2013 | Lee | |
| 2014/0109875 | A1 | 4/2014 | Lachaize | |
| 2014/0120440 | A1 | 5/2014 | Nolan et al. | |
| 2014/0144209 | A1 * | 5/2014 | Smither | F02D 41/0027 73/23.32 |
| 2014/0224217 | A1 | 8/2014 | Pursifull et al. | |
| 2014/0230794 | A1 | 8/2014 | Surnilla et al. | |
| 2014/0297071 | A1 | 10/2014 | Dudar et al. | |
| 2015/0027416 | A1 | 1/2015 | Brostrom et al. | |

OTHER PUBLICATIONS

Pursifull, Ross D. et al., "High Pressure Fuel Pump Control for Idle Tick Reduction," U.S. Appl. No. 14/042,971, filed Oct. 1, 2013, 34 pages.

Surnilla, Gopichandra et al., "Adaptive Learning of Duty Cycle for a High Pressure Fuel Pump," U.S. Appl. No. 14/099,615, filed Dec. 6, 2013, 44 pages.

Surnilla, Gopichandra et al., "Robust Direct Injection Fuel Pump System," U.S. Appl. No. 14/155,250, filed Jan. 14, 2014, 61 pages.

Pursifull, Ross D. et al., "Method and System for Characterizing a Port Fuel Injector," U.S. Appl. No. 14/192,768, filed Feb. 27, 2014, 44 pages.

Surnilla, Gopichandra et al., "High Pressure Fuel Pumps with Mechanical Pressure Regulation," U.S. Appl. No. 14/243,615, filed Apr. 2, 2014, 53 pages.

Ulrey, Joseph N. et al., "Adjusting Pump Volume Commands for Direct Injection Fuel Pumps," U.S. Appl. No. 14/300,162, filed Jun. 9, 2014, 42 pages.

Ulrey, Joseph N. et al., "Current Pulsing Control Methods for Lift Fuel Pumps," U.S. Appl. No. 14/444,739, filed Jul. 28, 2014, 48 pages.

Pursifull, Ross D., "Method and System for Supplying Liquefied Petroleum Gas to a Direct Fuel Injected Engine," U.S. Appl. No. 14/532,756, filed Nov. 4, 2014, 39 pages.

Pursifull, Ross D., "Method and System for Fuel System Control," U.S. Appl. No. 14/551,906, filed Nov. 24, 2014, 46 pages.

Sanborn, Ethan D. et al., "Identifying Fuel System Degradation," U.S. Appl. No. 14/558,295, filed Dec. 2, 2014, 53 pages.

Ulrey, Joseph N. et al., "Optimizing Intermittent Fuel Pump Control," U.S. Appl. No. 14/558,363, filed Dec. 2, 2014, 44 pages.

Pursifull, Ross D., "Method for Lift Pump Control," U.S. Appl. No. 14/558,482, filed Dec. 2, 2014, 53 pages.

Pursifull, Ross D., "Direct Injection Pump Control," U.S. Appl. No. 14/560,497, filed Dec. 4, 2014, 49 pages.

Surnilla, Gopichandra et al., "Methods and Systems for Fixed and Variable Pressure Fuel Injection," U.S. Appl. No. 14/570,546, filed Dec. 15, 2014, 51 pages.

* cited by examiner

SYSTEMS AND METHODS FOR SENSING FUEL VAPOR PRESSURE

BACKGROUND AND SUMMARY

Fuel composition may vary depending on the blending specifications for different regions based on climate and environmental regulations. Specifically, various additives may be added to fuel blends to alter fuel volatility based on the climate of the region where a fuel is sold. For example, fuels sold in southern areas with a warm climate may have a lower fuel volatility than fuels sold in northern areas with a cold climate so that the differences in climate corresponds to a difference in fuel volatility, thereby achieving a similar effect on emissions. Similarly, fuel volatility may vary throughout the year in a same region based on the climate of the region. For example, fuel dispensed at fuel pump may have a lower fuel volatility during warmer months than fuel dispensed during colder months. Furthermore, commercial fuel distributors may offer fuels comprising a blend of gasoline and ethanol (e.g., E10, E25, E85, etc.) to reduce carbon emissions. Further still, a fuel tank may be refueled with fuel of a particular composition while the fuel tank still contains some amount of fuel, possibly of a different composition. As a result, a typical fuel tank may contain a plurality of different fuel blends.

Meanwhile, environmental regulations mandate a decrease in vehicle emissions for vehicle manufacturers. As a result, vehicle control routines relating to engine operation, leak detection, and so on may depend on the combustion properties of a fuel to optimize engine efficiency and meet the environmental regulations. Furthermore, on-board diagnostic monitors of an engine control system also apply fuel volatility estimates, for example in the monitoring and detection of fuel system leaks. Reid vapor pressure (RVP), defined as the gauge pressure of a liquid fuel with a volume of air above it at a reference temperature (specifically, 100 degrees Fahrenheit), is typically used to estimate fuel volatility. RVP is a close estimate of the vapor pressure, which is an absolute pressure.

However, the relationship between vapor pressure and temperature is non-linear, and so two fuels with slight differences in RVP may have substantially different combustion properties at higher temperatures. As a result, even small errors in RVP estimation may lead to decreased engine efficiency and false results in fuel system leak detection tests, for example, thereby resulting in increased emissions.

One approach to resolving the issue of RVP estimation, at least in part, is to measure the absolute vapor pressure of a fuel at current operating temperatures. Aside from pressure variation due to elevation and flow, the pressure is uniform within a volume. The vapor pressure is set by the hottest surface in contact with the fluid. Placing a temperature sensor at the hottest point in the fuel system is difficult as temperature widely varies and the location of the hottest point is uncertain. Furthermore, a fuel system may intentionally operate at a vapor-liquid volume ratio of zero and so the fuel system is always above vapor pressure, thereby increasing the difficulty of accurately measuring the vapor pressure.

The inventors herein have recognized the above issues and have devised various approaches to address them. In particular, systems and methods for sensing fuel vapor pressure are provided. In one example, a method for a vehicle comprises: during an engine start after the engine has been off for at least a minimum duration, actively controlling fuel pressure in the fuel system to a vapor-liquid volume ratio greater than zero and then recording sensed fuel pressure and temperature in the fuel system. In this way, the vapor pressure of a fuel at a given temperature may be accurately measured during isothermal conditions, thereby improving an estimation of RVP. In turn, control methods regarding fuel injection, ignition timing, and emissions testing may be updated based on the improved RVP estimate, thereby increasing efficiency of engine operation and decreasing emissions.

In another example, a method comprises, pulsing a fuel pump responsive to an engine cold start, and determining a fuel vapor pressure versus temperature characteristic based on fuel pressure and temperature while the fuel pump is being pulsed in response to a reduction in DI pump volumetric efficiency. In this way, fuel volatility may be accurately determined and used for subsequent vehicle control routines, thereby improving engine efficiency and reducing emissions.

In another example, a fuel system for an engine comprises: a fuel tank containing fuel; a fuel pump positioned within the fuel tank and configured to pump the fuel to one or more fuel injectors coupled to the engine; a temperature sensor coupled to a fuel passage connecting the fuel pump to the one or more fuel injectors; a pressure sensor coupled to the fuel passage; and a controller configured with instructions stored in non-transitory memory, that when executed, cause the controller to: actively control the fuel pump responsive to the engine turning on after the engine has been off for at least a minimum duration; and record a sensed temperature from the temperature sensor and a sensed pressure from the pressure sensor. In this way, the vapor pressure and temperature of a fuel may be measured at the hottest point in the fuel system, thereby providing an improved estimation of fuel volatility.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 1:
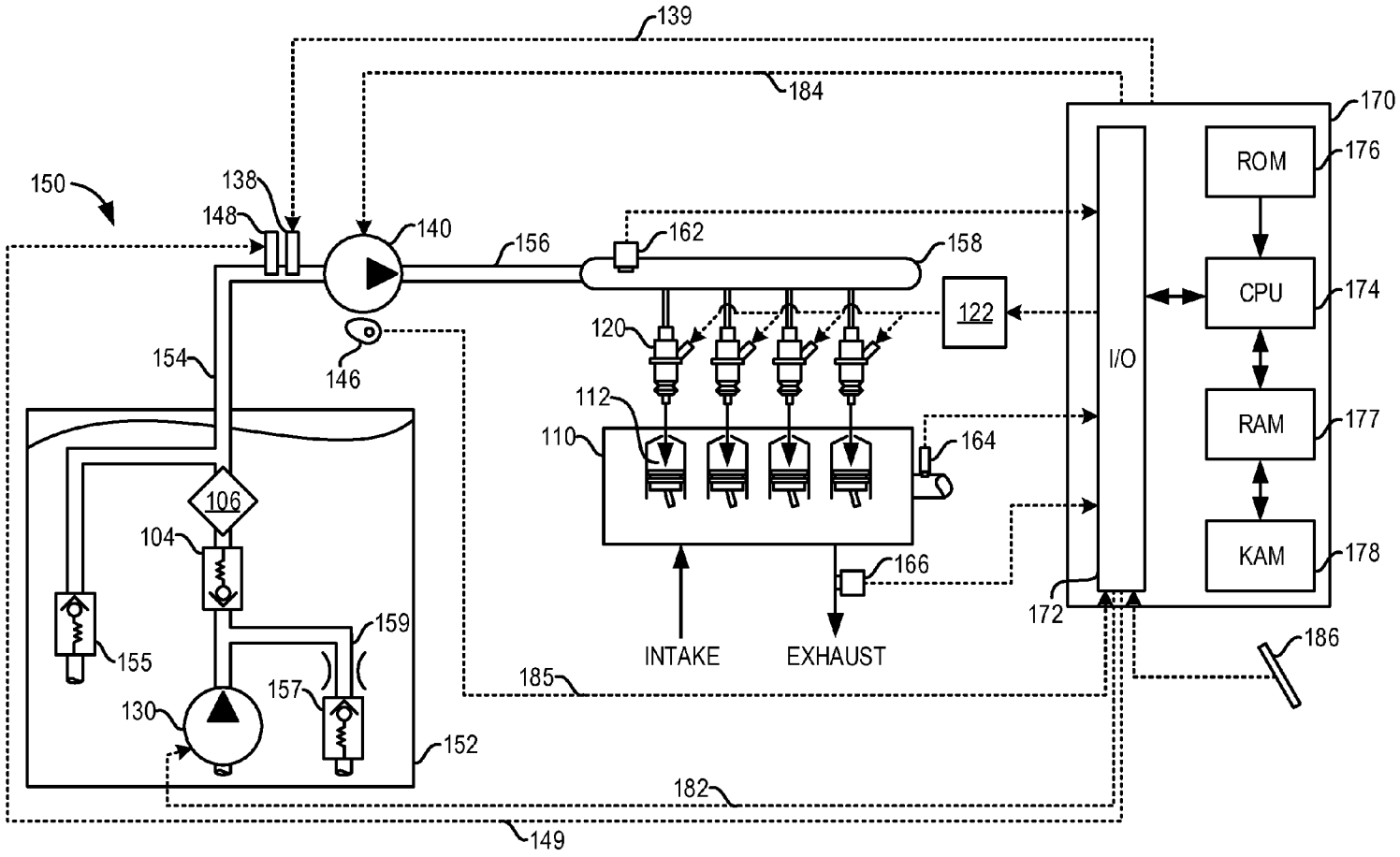
FIG. 1 shows a schematic representation of an example fuel system coupled to an engine.
Figure 2:
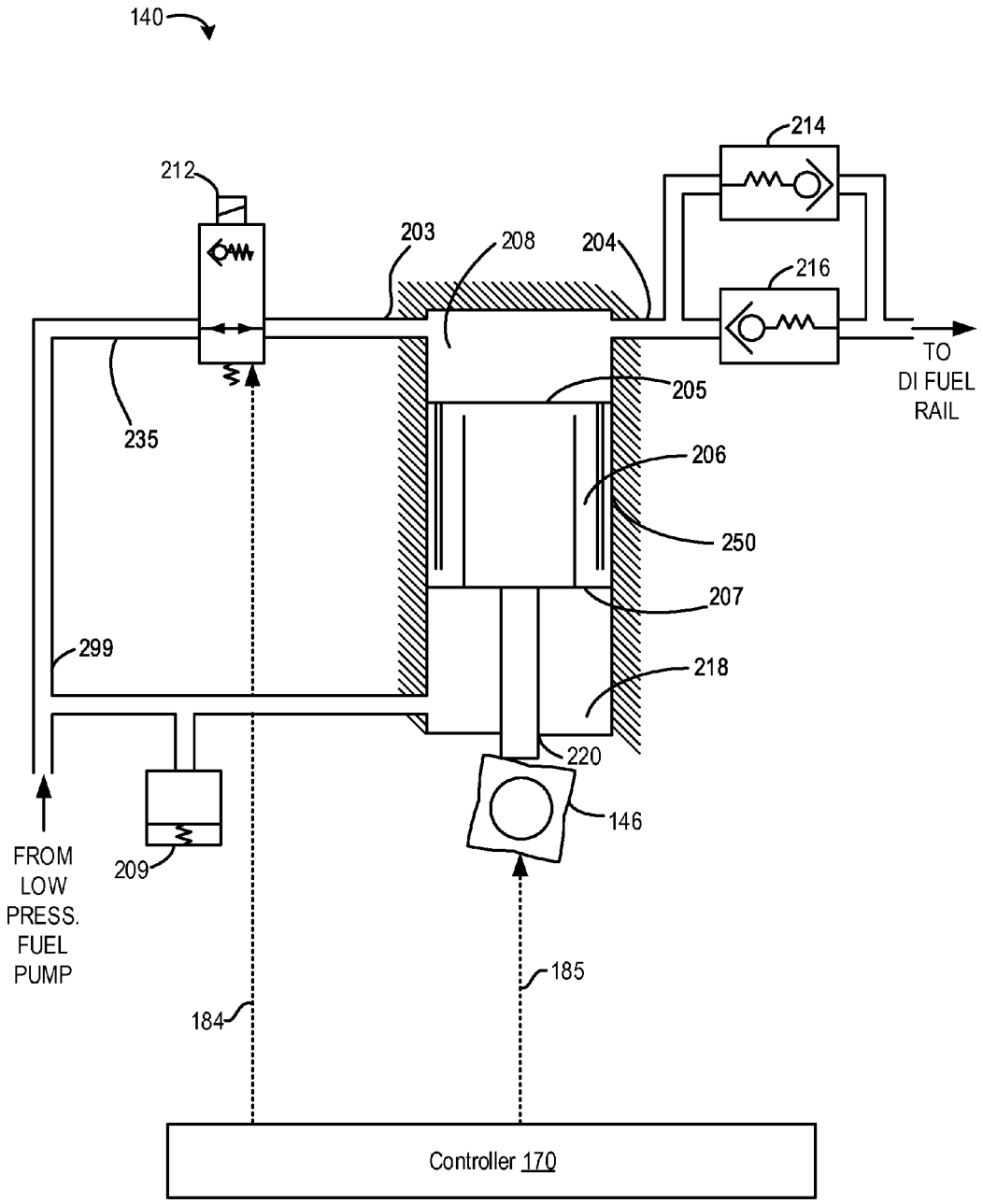
FIG. 2 shows a schematic diagram of an example direct injection fuel pump and related components included in the fuel system of FIG. 1.
Figure 3:
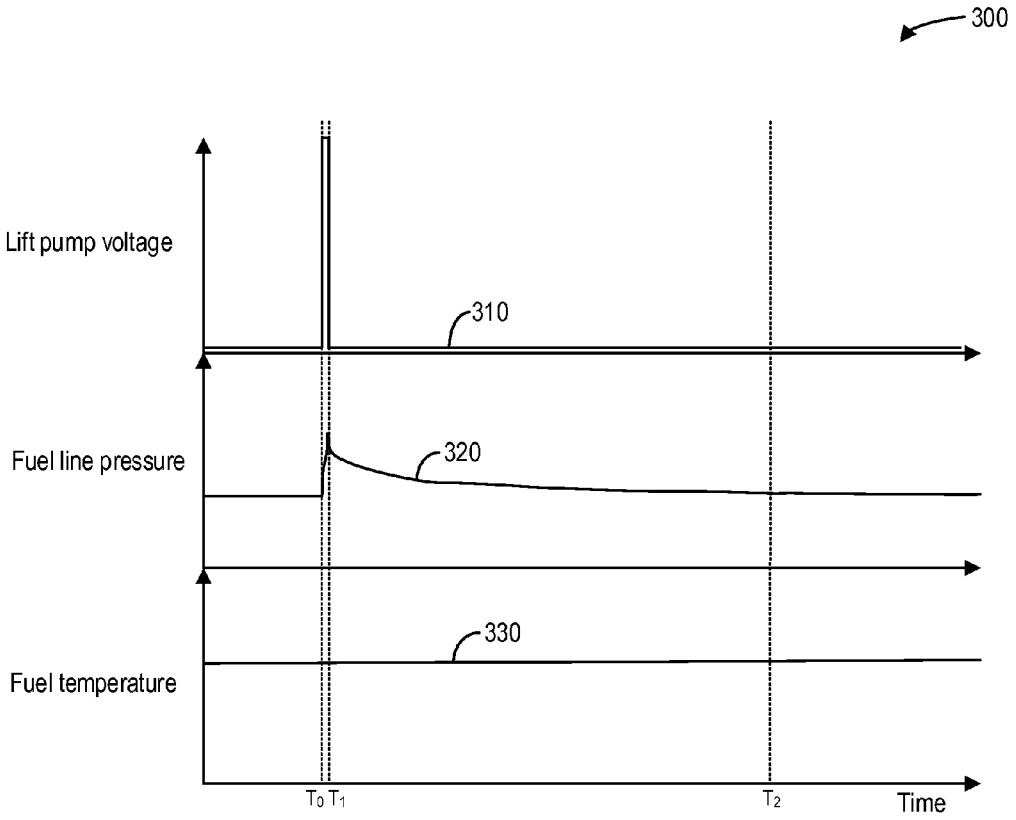
FIG. 3 shows a set of graphs illustrating a method for sensing fuel vapor pressure.
Figure 4:
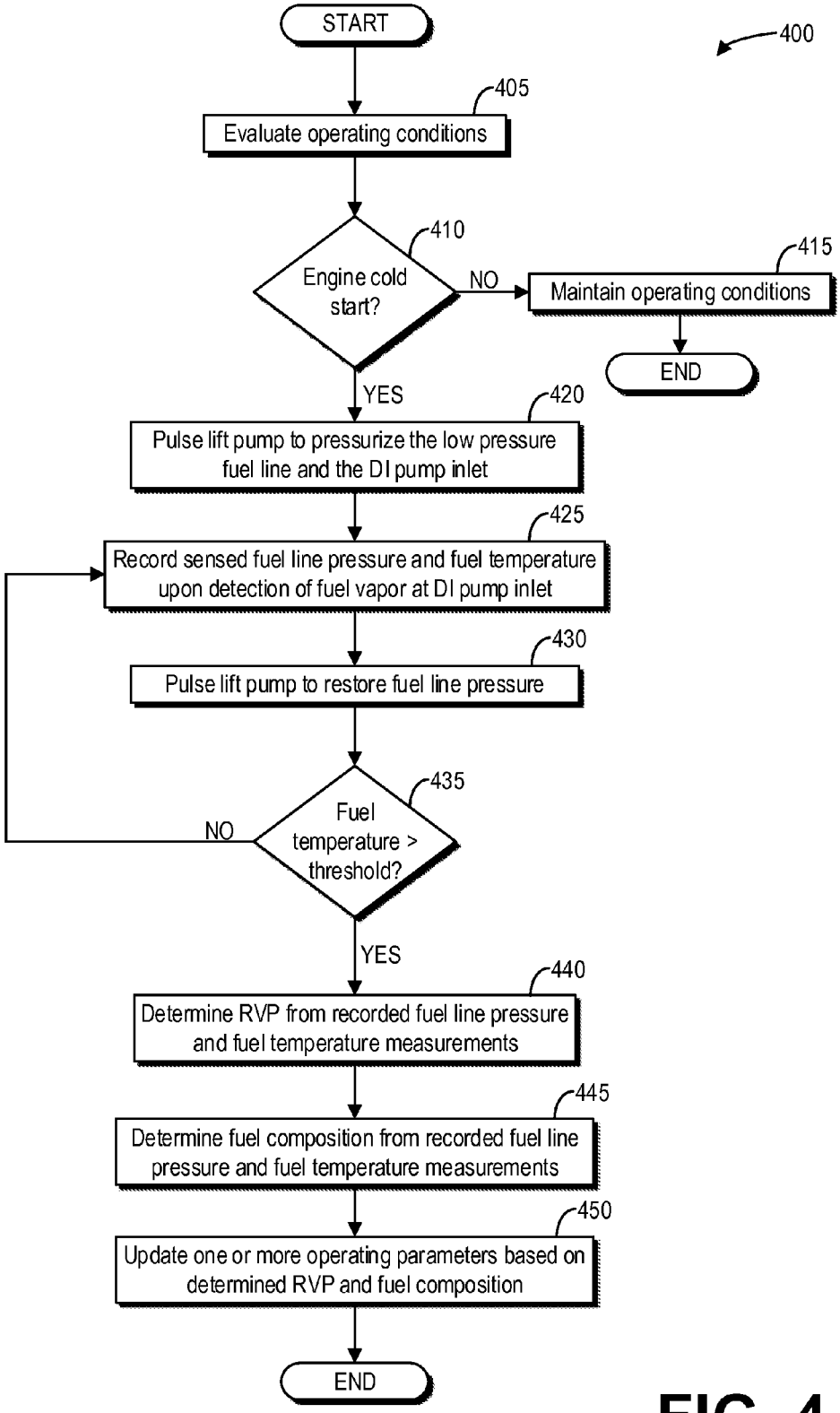
FIG. 4 shows a high-level flow chart illustrating an example method for sensing fuel vapor pressure.
Figure 5:
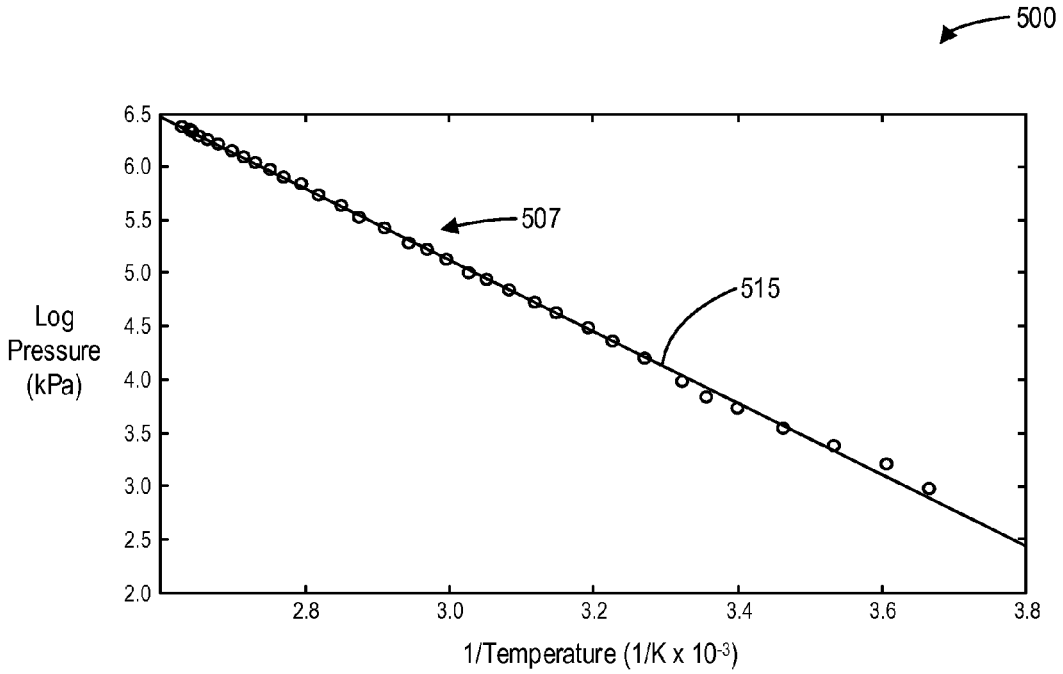
FIG. 5 shows a graph illustrating an example linear model for a collection of vapor pressure and temperature measurements.
Figure 6:
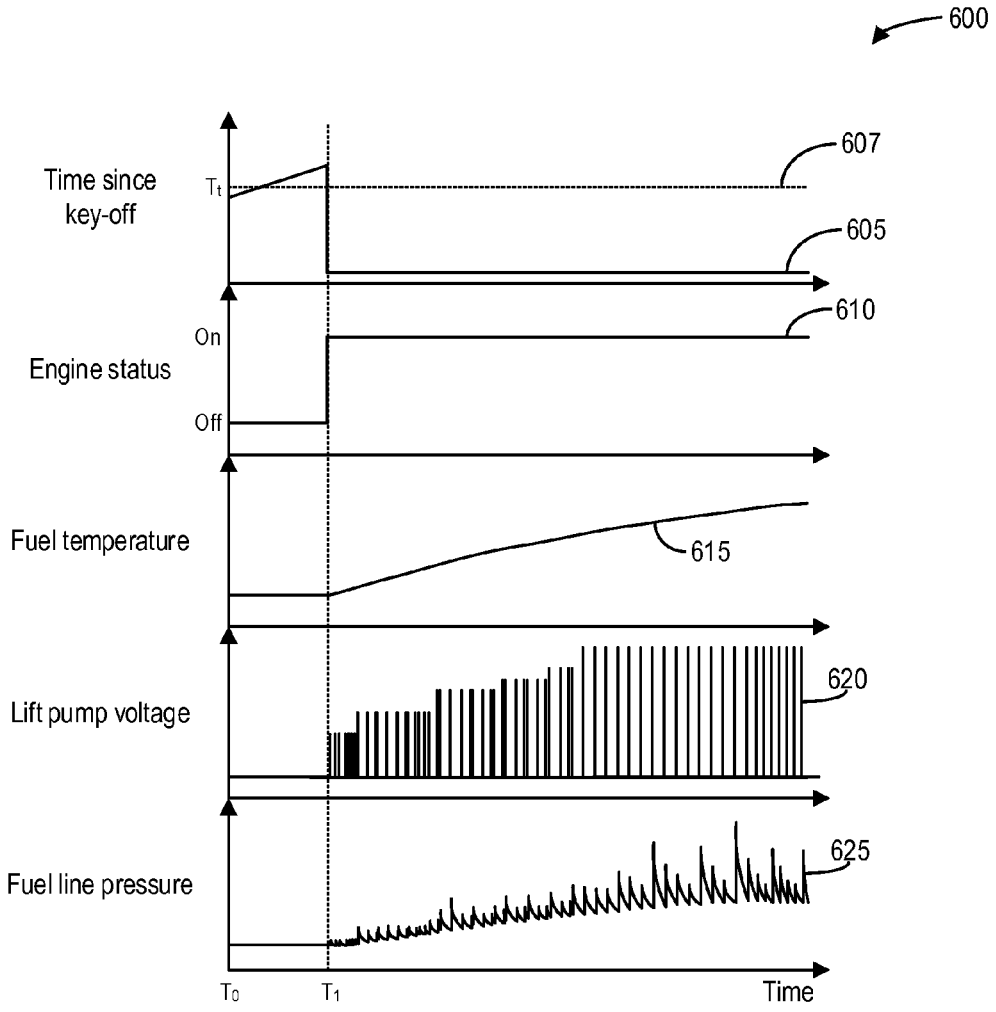
FIG. 6 shows a set of graphs illustrating an example timeline for the control method of FIG. 4.

The present description is related to determining various properties of fuel in a fuel system. Specifically, methods and systems are provided for sensing fuel vapor pressure after an engine cold start. A simplified schematic diagram of an example direct injection fuel system and engine is shown in FIG. 1 while FIG. 2 shows a detailed view of a direct injection fuel pump of FIG. 1 and associated components. A lift fuel pump may be operated in a pulse mode to sense vapor pressure, as illustrated in FIG. 3. FIG. 4 shows a flow chart illustrating a method for actively controlling a lift fuel pump to sense fuel vapor pressure and temperature during a cold start. FIG. 5 shows how a fuel composition and RVP may be determined from sensed fuel vapor pressure and temperature. Lastly, FIG. 6 shows several graphs of example operation of the lift fuel pump.

Regarding terminology used throughout this detailed description, a higher-pressure fuel pump, or direct injection fuel pump, that provides pressurized fuel to a direct injection fuel rail and attached injectors may be abbreviated as a DI or HP pump. Similarly, a lower-pressure pump (compressing fuel at pressures generally lower than that of the DI pump), or lift fuel pump, that provides pressurized fuel from a fuel tank to the DI pump may be abbreviated as an LP pump. A solenoid spill valve, which may be electronically energized to allow check valve operation and de-energized to open (or vice versa), may also be referred to as a fuel volume regulator, magnetic solenoid valve, and a digital inlet valve, among other names.

FIG. 1 shows a direct injection fuel system 150 coupled to an internal combustion engine 110, which may be configured as part of a propulsion system for a vehicle. The internal combustion engine 110 may comprise multiple combustion chambers or cylinders 112. Fuel can be provided directly to the cylinders 112 via in-cylinder direct injectors 120. As indicated schematically by arrows in FIG. 1, the engine 110 can also receive intake air and exhaust products of the combusted fuel. For simplicity, the intake and exhaust systems are not shown in FIG. 1. The engine 110 may include a suitable type of engine including a gasoline or diesel engine. In other embodiments, the combusted fuel may include other individual fuels or a combination of different fuels.

Fuel can be provided to the engine 110 via the injectors 120 by way of the direct injection fuel system indicated generally at 150. In this particular example, the fuel system 150 includes a fuel storage tank 152 for storing the fuel on-board the vehicle, a low-pressure fuel pump 130 (e.g., a fuel lift pump), a high-pressure fuel pump or direct injection (DI) pump 140, a fuel rail 158, and various fuel passages 154 and 156. In the example shown in FIG. 1, the fuel passage 154 carries fuel from the low-pressure pump 130 to the DI pump 140, and the fuel passage 156 carries fuel from the DI pump 140 to the fuel rail 158. Due to the locations of the fuel passages, passage 154 may be referred to as a low-pressure fuel passage while passage 156 may be referred to as a high-pressure fuel passage. As such, fuel in passage 156 may exhibit a higher pressure than fuel in passage 154. In some examples, fuel system 150 may include more than one fuel storage tank and additional passages, valves, and other devices for providing additional functionality to direct injection fuel system 150.

In the present example of FIG. 1, fuel rail 158 may distribute fuel to each of a plurality of direct fuel injectors 120. Each of the plurality of fuel injectors 120 may be positioned in a corresponding cylinder 112 of engine 110 such that during operation of fuel injectors 120 fuel is injected directly into each corresponding cylinder 112. Alternatively or additionally, engine 110 may include fuel injectors positioned at or near the intake port of each cylinder such that during operation of the fuel injectors, fuel is injected with the charge air into the one or more intake ports of each cylinder. This configuration of injectors may be part of a port fuel injection system, which may be included in fuel system 150. In the illustrated embodiment, engine 110 includes four cylinders that are only fueled via direct injection. However, it will be appreciated that the engine may include a different number of cylinders along with a combination of both port and direct fuel injection.

The low-pressure fuel pump 130 may be operated by a controller 170 to provide fuel to DI pump 140 via fuel low-pressure passage 154. The low-pressure fuel pump 130 may be configured as what may be referred to as a fuel lift pump. As one example, low-pressure fuel pump 130 may include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power that is provided to LP pump 130, the volumetric flow rate and/or pressure increase across the pump may be reduced. Alternatively, the volumetric flow rate and/or pressure increase across the pump may be increased by increasing the electrical power that is provided to the pump 130. As one example, the electrical power supplied to the low-pressure pump motor may be obtained from an alternator or other energy storage device on-board the vehicle (not shown), whereby the control system provided by controller 170 may control the electrical load that is used to power the low-pressure pump 130. Thus, by varying the voltage and/or current provided to the low-pressure fuel pump 130, as indicated at 182, the flow rate and pressure of the fuel provided to DI pump 140 and ultimately to the fuel rail 158 may be adjusted by the controller 170.

Low-pressure fuel pump 130 may be fluidly coupled to check valve 104 which may facilitate fuel delivery and maintain fuel line pressure. Filter 106 may be fluidly coupled to outlet check valve 104 via low-pressure passage 154. Filter 106 may remove small impurities that may be contained in the fuel that could potentially damage fuel handling components. With check valve 104 upstream of the filter 106, the compliance of low-pressure passage 154 may be increased since the filter may be physically large in volume. Furthermore, pressure relief valve 155 includes a ball and spring mechanism that seats and seals at a specified pressure differential to relieve fuel to limit the fuel pressure at 154. An orifice check valve 157 may be placed in series with an orifice 159 to allow for air and/or fuel vapor to bleed out of the lift pump 130. As seen in FIG. 1, check valve 104 is oriented such that fuel backflow from DI pump 140 to the low-pressure pump 130 is substantially reduced (i.e., eliminated). In some embodiments, fuel system 150 may include a series of check valves fluidly coupled to low-pressure fuel pump 130 to further impede fuel from leaking back upstream of the valves. In this context, upstream flow refers to fuel flow traveling from fuel rail 158 towards low-pressure pump 130 while downstream flow refers to the nominal fuel flow direction from the low-pressure pump towards the fuel rail.

Next, fuel may be delivered from check valve 104 to high-pressure fuel pump (e.g., DI pump) 140. DI pump 140 may increase the pressure of fuel received from the check valve 104 from a first pressure level generated by low-pressure fuel pump 130 to a second pressure level higher than the first level. DI pump 140 may deliver high pressure fuel to fuel rail 158 via high-pressure fuel line 156. Operation of DI pump 140 may be adjusted based on operating conditions of the vehicle in order to provide more efficient fuel system and engine operation. The components of the high-pressure DI pump 140 will be discussed in further detail below with reference to FIG. 2.

The DI pump 140 may be controlled by the controller 170 to provide fuel to the fuel rail 158 via the high-pressure fuel passage 156. As one non-limiting example, DI pump 140 may utilize a flow control valve, a solenoid actuated "spill valve" (SV), or fuel volume regulator (FVR) to enable the control system to vary the effective pump volume of each pump stroke. The spill valve, described in more detail in FIG. 2, may be separate or a part of (i.e., integrally formed with) DI pump 140. The DI pump 140 may be mechanically driven by the engine 110 in contrast to the motor-driven low-pressure fuel pump or fuel lift pump 130. A pump piston of the DI pump 140 may receive a mechanical input from the engine crank shaft or cam shaft via a cam 146. In this manner, DI pump 140 may be operated according to the principle of a cam-driven, single-cylinder pump. Furthermore, the angular position of cam 146 may be estimated (i.e., determined) by a sensor located near cam 146 communicating with controller 170 via connection 185. In particular, the sensor may measure an angle of cam 146 measured in degrees ranging from 0 to 360 degrees according to the circular motion of cam 146. While cam 146 is shown outside of DI pump 140 in FIG. 1, it should be understood that cam 146 may be included in the system of DI pump 140.

As depicted in FIG. 1, a fuel pressure sensor 148 is disposed downstream of the fuel lift pump 130. In particular, fuel pressure sensor 148 may be located in low-pressure passage 154 between the lift pump 130 and the DI pump 140, and may be referred to as the lift pump pressure sensor or the low-pressure sensor. The fuel pressure sensor 148 may measure pressure within the low-pressure fuel passage 154. The pressure sensor 148 may be connected to controller 170 via connection 149 and used, in some examples described further herein, to measure a fuel vapor pressure.

Furthermore, as depicted in FIG. 1, a fuel temperature sensor 138 is disposed downstream of the fuel lift pump 130. In particular, fuel temperature sensor 138 may be located in low-pressure passage 154 between the lift pump 130 and the DI pump 140. The fuel temperature sensor 138 may measure temperature within the low-pressure fuel passage 154. The temperature sensor 138 may be connected to controller 170 via connection 139 and used, in some examples described further herein, to measure a fuel temperature. In some examples, temperature sensor 138 may be located upstream of fuel lift pump 130 or downstream of DI pump 140.

In some examples, the DI pump 140 may be operated as a fuel sensor to determine the level of fuel vaporization. For example, a piston-cylinder assembly of the DI pump 140 forms a fluid-filled capacitor. As such, the piston-cylinder assembly allows the DI pump 140 to be the capacitive element in the fuel composition sensor. In some examples, the piston-cylinder assembly of the DI pump 140 may be the hottest point in the system, such that fuel vapor forms there first. In such an example, the DI pump 140 may be utilized as the sensor for detecting fuel vaporization, as fuel vaporization may occur at the piston-cylinder assembly before it occurs anywhere else in the system. Other fuel sensor configurations may be possible while pertaining to the scope of the present disclosure.

As shown in FIG. 1, the fuel rail 158 includes a fuel rail pressure sensor 162 for providing an indication of fuel rail pressure to the controller 170. An engine speed sensor 164 may be used to provide an indication of engine speed to the controller 170. The indication of engine speed may be used to identify the speed of DI pump 140, since the pump 140 is mechanically driven by the engine 110, for example, via the crankshaft or camshaft. An exhaust gas sensor 166 may be used to provide an indication of exhaust gas composition to the controller 170. As one example, the gas sensor 166 may include a universal exhaust gas oxygen (UEGO) sensor. The exhaust gas oxygen sensor 166 may be used as feedback by the controller 170 to adjust the amount of fuel that is delivered to the engine 110 via the injectors 120. In this way, the controller 170 may control the air/fuel ratio delivered to the engine to a prescribed set-point.

Furthermore, controller 170 may receive other engine/exhaust parameter signals from other engine sensors such as engine coolant temperature, engine speed, throttle position, absolute manifold pressure, emission control device temperature, etc. Further still, controller 170 may provide feedback control based on signals received from temperature sensor 138, pressure sensor 148, pressure sensor 162, and engine speed sensor 164, among others. For example, controller 170 may send signals to adjust a current level, current ramp rate, pulse width of a solenoid valve (SV) of DI pump 140, and the like via connection 184 to adjust operation of DI pump 140. Also, controller 170 may send signals to adjust a fuel pressure set-point of a fuel pressure regulator and/or a fuel injection amount and/or timing based on signals from pressure sensor 148, pressure sensor 162, engine speed sensor 164, and the like. Other sensors not shown in FIG. 1 may be positioned around engine 110 and fuel system 150.

The controller 170 may individually actuate each of the injectors 120 via a fuel injection driver 122. The controller 170, the driver 122, and other suitable engine system controllers may comprise a control system. While the driver 122 is shown external to the controller 170, in other examples, the controller 170 may include the driver 122 or the controller may be configured to provide the functionality of the driver 122. The controller 170, in this particular example, includes an electronic control unit comprising one or more of an input/output device 172, a central processing unit (CPU) 174, read-only memory (ROM) 176, random-access memory (RAM) 177, and keep-alive memory (KAM) 178. The storage medium ROM 176 may be programmed with computer-readable data representing non-transitory instructions executable by the processor 174 for performing the methods described below as well as other variants that are anticipated but not specifically listed. For example, controller 170 may contain stored instructions for executing various control schemes of DI pump 140 and LP pump 130 based on several measured operating conditions from the aforementioned sensors.

As shown in FIG. 1, direct injection fuel system 150 is a returnless fuel system, and may be a mechanical returnless fuel system (MRFS) or an electronic returnless fuel system (ERFS). In the case of an MRFS, the fuel rail pressure may be controlled via a pressure regulator (pressure relief valve 155) positioned at the fuel tank 152. In an ERFS, a pressure sensor 162 may be mounted at the fuel rail 158 to measure the fuel rail pressure; however, the open loop scheme described herein relegates the pressure sensor 162 to diagnostic purposes only and thus inclusion of the pressure sensor is discretionary. The signal from the pressure sensor 162 may be fed back to the controller 170, which controls the driver 122, the driver 122 modulating the voltage to the DI pump 140 for supplying the correct pressure and fuel flow rate to the injectors.

Although not shown in FIG. 1, in other examples, direct injection fuel system 150 may include a return line whereby excess fuel from the engine 110 is returned via a fuel pressure regulator to the fuel tank 152 via a return line. The fuel pressure regulator may be coupled in-line with the return line to regulate fuel delivered to fuel rail 158 at a set-point pressure. To regulate the fuel pressure at the set-point, the fuel pressure regulator may return excess fuel to fuel tank 152 via the return line upon fuel rail pressure reaching the set-point. It will be appreciated that operation of the fuel pressure regulator may be adjusted to change the fuel pressure set-point to accommodate operating conditions.

FIG. 2 shows DI pump 140 of FIG. 1 in more detail. DI pump 140 intakes fuel from low-pressure passage 154 during an intake stroke and delivers the fuel to the engine via high-pressure passage 156 during a delivery stroke. DI pump 140 includes a compression chamber inlet 203 in fluidic communication with a compression chamber 208 that may be supplied fuel via low-pressure fuel pump 130 as shown in FIG. 1. The fuel may be pressurized upon its passage through direct injection fuel pump 140 and supplied to fuel rail 158 (and direct injectors 120) through pump outlet 204. In the depicted example, direct injection pump 140 may be a mechanically-driven displacement pump that includes a pump piston 206 and piston rod 220, a pump compression chamber 208, and a step-room 218. A passage that connects step-room 218 to a pump inlet 299 may include an accumulator 209, wherein the passage allows fuel from the step-room 218 to re-enter the low pressure line surrounding inlet 299. The accumulator 209 may absorb fuel refluxed from the pump chamber 208 back through valve 212. Piston 206 also includes a top 205 and a bottom 207. The step-room 218 and compression chamber 208 may include cavities positioned on opposing sides of the pump piston. In one example, engine controller 170 may be configured to drive the piston 206 in direct injection pump 140 by driving cam 146 via rotation of the engine crankshaft. In one example, cam 146 includes four lobes and completes one rotation for every two engine crankshaft rotations.

DI pump inlet 299 allows fuel to spill valve 212 located along passage 235. Spill valve 212 is in fluidic communication with the low-pressure fuel pump 130 and high-pressure fuel pump 140. Piston 206 reciprocates up and down within compression chamber 208 according to intake and delivery/compression strokes. DI pump 140 is in a delivery/compression stroke when piston 206 is traveling in a direction that reduces the volume of compression chamber 208. Alternatively, DI pump 140 is in an intake/suction stroke when piston 206 is traveling in a direction that increases the volume of compression chamber 208. A forward flow outlet check valve 216 may be coupled downstream of an outlet 204 of the compression chamber 208. Outlet check valve 216 opens to allow fuel to flow from the compression chamber outlet 204 into the fuel rail 158 only when a pressure at the outlet of direct injection fuel pump 140 (e.g., a compression chamber outlet pressure) is higher than the fuel rail pressure. Operation of DI pump 140 may increase the pressure of fuel in compression chamber 208 and upon reaching a pressure set-point, fuel may flow through outlet valve 216 to fuel rail 158. A pressure relief valve 214 may be placed such that the valve limits the pressure in the DI fuel rail 158. Valve 214 may be biased to inhibit fuel from flowing downstream to fuel rail 158 but may allow fuel flow out of the DI fuel rail 158 toward pump outlet 204 when the fuel rail pressure is greater than a predetermined pressure (i.e., pressure setting of valve 214).

The solenoid spill valve 212 may be coupled to compression chamber inlet 203. As presented above, direct injection or high-pressure fuel pumps such as pump 140 may be piston pumps that are controlled to compress a fraction of their full displacement by varying closing timing of the solenoid spill valve 212. As such, a full range of pumping volume fractions may be provided to the direct injection fuel rail 158 and direct injectors 120 depending on when the spill valve 212 is energized and de-energized. In particular, controller 170 may send a pump signal that may be modulated to adjust the operating state (e.g., open or closed, check valve) of SV 212. Modulation of the pump signal may include adjusting a current level, current ramp rate, a pulse-width, a duty cycle, or another modulation parameter. Mentioned above, controller 170 may be configured to regulate fuel flow through spill valve 212 by energizing or de-energizing the solenoid (based on the solenoid valve configuration) in synchronism with the driving cam 146. Accordingly, solenoid spill valve 212 may be operated in two modes. In a first mode, solenoid spill valve 212 is not energized (deactivated or disabled) to an open position to allow fuel to travel upstream and downstream of a check valve contained in solenoid valve 212. During this mode, pumping of fuel into passage 156 cannot occur as fuel is pumped upstream through de-energized, open spill valve 212 instead of out of outlet check valve 216.

Alternatively, in the second mode, spill valve 212 is energized (activated) by controller 170 to a closed position such that fluidic communication across the valve is disrupted to limit (e.g., inhibit) the amount of fuel traveling upstream through the solenoid spill valve 212. In the second mode, spill valve 212 may act as an inlet check valve which allows fuel to enter chamber 208 upon reaching the set pressure differential across valve 212 but substantially prevents fuel from flowing backward from chamber 208 into passage 235. Depending on the timing of the energizing and de-energizing of the spill valve 212, a given amount of pump displacement is used to push a given fuel volume into the fuel rail 158, thus allowing the spill valve 212 to function as a fuel volume regulator. As such, the timing of the solenoid valve 212 may control the effective pump displacement. Controller 170 of FIG. 1 is included in FIG. 2 for operating solenoid spill valve 212 via connection 184. Furthermore, connection 185 to measure the angular position of cam 146 is shown in FIG. 2. In some control schemes, angular position (i.e., the timing) of cam 146 may be used to determine opening and closing timings of spill valve 212.

As such, solenoid spill valve 212 may be configured to regulate the mass (or volume) of fuel compressed into the direct injection fuel pump. In one example, controller 170 may adjust a closing timing of the solenoid spill valve 212 to regulate the mass of fuel compressed. For example, a late spill valve 212 closing may reduce the amount of fuel mass ingested into the compression chamber 208. The solenoid spill valve opening and closing timings may be coordinated with respect to stroke timings of the direct injection fuel pump.

During conditions when direct injection fuel pump operation is not requested, controller 170 may activate and deactivate solenoid spill valve 212 to regulate fuel flow and pressure in compression chamber 208 to a pressure less than the fuel rail pressure during the compression (delivery) stroke. Control of the DI pump 140 in this way may be included in zero flow lubrication (ZFL) methods. During such ZFL operation, on the intake stroke the pressure in compression chamber 208 varies to a pressure near the pressure of the lift pump 130 and just below the fuel rail pressure. Subsequently, the pump pressure rises to a pressure near the fuel rail pressure at the end of the delivery (compression) stroke. If the compression chamber (pump) pressure remains below the fuel rail pressure, zero fuel flow results. When the compression chamber pressure is slightly below the fuel rail pressure, the ZFL operating point has been reached. In other words, the ZFL operating point is the highest compression chamber pressure that results in zero flow rate (i.e., substantially no fuel sent into fuel rail 158). Lubrication of the DI pump's piston-cylinder interface may occur when the pressure in compression chamber 208 exceeds the pressure in step-room 218. This difference in pressures may also contribute to pump lubrication when controller 170 deactivates solenoid spill valve 212. Deactivation of spill valve 212 may also reduce noise produced by valve 212. Said another way, even though the solenoid valve 212 is energized, if the outlet check valve 216 does not open, then the pump 140 may produce less noise than during other operating schemes. One result of this regulation method is that the fuel rail is regulated to a pressure depending on when the solenoid spill valve 212 is energized during the delivery stroke. Specifically, the fuel pressure in compression chamber 208 is regulated during the compression (delivery) stroke of direct injection fuel pump 140. Thus, during at least the compression stroke of direct injection fuel pump 140, lubrication is provided to the pump. When the DI pump enters a suction stroke, fuel pressure in the compression chamber 208 may be reduced while still some level of lubrication may be provided as long as the pressure differential remains.

As an example, a zero flow lubrication strategy may be commanded when direct fuel injection is not desired (i.e., requested by the controller 170). When direct injection ceases, pressure in the fuel rail 158 is desired to remain at a near-constant level. As such, the spill valve 212 may be deactivated to the open position to allow fuel to freely enter and exit the pump compression chamber 208 so fuel is not pumped into the fuel rail 158. An always-deactivated spill valve corresponds to a 0% trapping volume, that is, zero trapped volume or zero displacement. As such, lubrication and cooling of the DI pump 140 may be reduced while no fuel is being compressed, thereby leading to pump degradation. Therefore, according to ZFL methods, it may be beneficial to energize the spill valve 212 to pump a small amount of fuel when direct injection is not requested. As such, operation of the DI pump 140 may be adjusted to maintain a pressure at the outlet of the DI pump 140 at or below the fuel rail pressure of the direct injection fuel rail 158, thereby forcing fuel past the piston-bore interface of the DI pump 140. By maintaining the outlet pressure of the DI pump 140 just below the fuel rail pressure and without allowing fuel to flow out of the outlet of the DI pump 140 into the fuel rail, the DI pump 140 may be kept lubricated, thereby reducing pump degradation. This general operation may be referred to as zero flow lubrication (ZFL).

It is noted here that DI pump 140 of FIG. 2 is presented as an illustrative, simplified example of one possible configuration for a DI pump. Components shown in FIG. 2 may be removed and/or changed while additional components not presently shown may be added to pump 140 while still maintaining the ability to deliver high-pressure fuel to a direct injection fuel rail. In particular, the zero flow lubrication methods described above may be implemented in various configurations of DI pump 140 without adversely affecting normal operation of the pump 140.

In the context of the present disclosure, continuous pump operation includes supplying a substantially constant current (i.e., power or energy) to the lift fuel pump 130. Alternatively, pulsed pump operation includes supplying current to the lift pump during a limited time duration. Within this context, the limited time duration may be a threshold such as 0.3 seconds or another suitable quantity depending on the engine and fuel systems. In between pump pulsation events, substantially no current (i.e., none) is provided to the lift pump, thereby ceasing pump operation in between pulsation events.

Conventionally, lift fuel pump control methods are configured to maintain a vapor-liquid volume ratio of zero within low-pressure fuel passage 154. In other words, lift fuel pump 130 may be operated to prevent the formation of fuel vapor within low-pressure fuel passage 154. However, in some examples, a lift fuel pump control method may include intermittently providing electrical power to the lift fuel pump 130 of FIG. 1 to drive a vapor-liquid volume ratio of fuel in low-pressure fuel passage 154 to a non-zero value. In other words, by providing pulsations of electrical current to the lift fuel pump 130 whenever one or more conditions are met, the low pressure fuel passage 154 may be pressurized and may include a combination of vaporized and liquid fuel. The claimed method takes advantage of the ability to detect vapor at the DI pump inlet 299 or the ingestion of vapor into the compression chamber 208 of DI pump 140. At this point, the pressure sensor is exposed to a pressure close to the fuel vapor pressure. Multiple methods for vapor detection exist. One example method that may be used includes comparing the fuel commanded to be pumped with the fuel amount actually pumped. For example, during an engine cold start when the temperature of fuel system 150 may be considered isothermal, lift fuel pump 130 may be pulsed to intentionally produce fuel vapor at the DI pump inlet 299. In this way, as described further herein, a measurement of vapor pressure at a given temperature may be obtained.

FIG. 3 shows a set of graphs 300 illustrating an example method for sensing fuel vapor pressure. In particular, graphs 300 relate to applying a voltage pulse to a lift fuel pump to drive a vapor-liquid volume ratio to a non-zero value. The graphs 300 will be described herein with reference to the components and systems depicted in FIGS. 1 and 2, though it should be understood that the method may be applied to other systems without departing from the scope of this disclosure.

Prior to time $T_0$, the lift pump 130 receives substantially no input voltage (i.e., zero volts), as indicated by plot 310. The fuel line pressure and the fuel temperature are substantially constant, as indicated respectively by plots 320 and 330.

At time $T_0$, the lift pump receives a voltage pulse as indicated by plot 310. The lift pump voltage may comprise a voltage on the order of, for example, seven to fifteen volts depending on the fuel temperature shown by plot 330.

The lift pump voltage pulse lasts from times $T_0$ to $T_1$, as shown by plot 310. The lift pump voltage 310 powers the lift pump 130, pumping fuel from the fuel tank 154 to the low-pressure fuel passage 154. The low-pressure fuel passage 154 becomes pressurized as the lift pump 130 pumps fuel into the fuel passage 154, as indicated by the increase in fuel line pressure shown by plot 320. Specifically, as soon as the lift pump voltage increases, there is a corresponding rise in lift pump pressure.

At time $T_1$, the lift pump voltage pulse ends and the input voltage to the lift pump 130 returns to zero, as shown by plot 310. As a result, the fuel line pressure shown by plot 320 decreases after time $T_1$. The rate of change of fuel line pressure may depend on the compliance of the low-pressure fuel passage 154.

From times $T_1$ to $T_2$, the lift pump 130 receives substantially no lift pump voltage (i.e., zero volts) as shown by plot 310. In the absence of a supplied lift pump voltage, the fuel line pressure decreases until the fuel line pressure reaches vapor pressure at time $T_2$, as shown by plot 320. As shown by plot 330, the fuel temperature remains substantially constant despite the increase in fuel line pressure.

At time $T_2$, the controller 170 may record the fuel line pressure measured by pressure sensor 148 and depicted by plot 320. The recorded pressure may comprise the vapor pressure at a given temperature, namely the temperature at time $T_2$ indicated by plot 330 and measured by temperature sensor 138. In this way, an ordered pair of vapor pressure and temperature may be obtained.

FIG. 4 shows a high-level flowchart illustrating an example method 400 for measuring vapor pressure and temperature in accordance with the current disclosure. In particular, method 400 relates to measuring vapor pressure and temperature after an engine cold-start responsive to detecting fuel vapor in the fuel system. Method 400 will be described herein with reference to the components and systems depicted in FIGS. 1 and 2, though it should be understood that the method may be applied to other systems without departing from the scope of this disclosure. Method 400 may be carried out by controller 170, and may be stored as executable instructions in non-transitory memory.

Method 400 may begin at 405. At 405, method 400 may include evaluating operating conditions. Operating conditions may include, but are not limited to, fuel system pressure, fuel temperature, time since key-off, engine operating status, engine coolant temperature, engine load, etc. Operating conditions may be measured by one or more sensors coupled to controller 170, or may be estimated or inferred based on available data.

At 410, method 400 may include determining if an engine cold start has occurred. Determining if an engine cold start has occurred may comprise, for example, determining if the engine 110 has started, and if so, if cold-start conditions are satisfied. For example, the engine is off when no combustion occurs within the engine and there is no rotation (i.e., zero speed). Determining if the engine 110 has started may comprise, for example, determining if an on/off button is pressed or a similar user input (such as a key start) has been performed while the vehicle has been in an off mode. By beginning this process when fuel temperature is cold and continuing as the fuel temperature naturally increases with increased operating temperatures, data points may be obtained over a desired temperature range.

In one example, determining if cold-start conditions are satisfied may comprise determining how much time has passed since a key-off event. For example, if the time since a key-off event is greater than a threshold, then the engine 110 and fuel system 150 may be assumed to satisfy cold-start conditions. Cold-start conditions may include one or more system temperatures below one or more temperature thresholds. As such, in another example, determining if cold-start conditions are satisfied may include determining if one or more system temperatures are below one or more temperature thresholds. For example, an engine coolant temperature (ECT) below a temperature threshold may indicate that the engine 110 has not yet warmed up beyond cold-start conditions, while a fuel system temperature below a temperature threshold may indicate that the fuel system 150 has not been warmed by engine operating conditions. In some examples, determining if cold-start conditions are satisfied may include determining that all system temperatures are below a same threshold in conjunction with determining a time since last key-off.

If an engine cold start has not occurred, method 400 may continue to 415. At 415, method 400 may include maintaining operating conditions, such as the conditions evaluated at 405. Method 400 may then end.

However, if an engine cold start has occurred, method 400 may proceed to 420. At 420, method 400 may include pulsing the lift pump to pressurize the low-pressure fuel line 154 and the DI pump inlet 299. Pulsing the lift fuel pump 130 rather than continuously operating the lift fuel pump 130 may agitate the liquid fuel in the low-pressure fuel passage 154, thereby generating additional fuel vapor. As a result, the fuel line pressure may be increased while the fuel system temperature remains isothermal and uniform through the fuel system 150, as described herein above with regard to FIG. 3. In this way, the vapor-liquid volume ratio of the fuel system 150, conventionally maintained at zero, may be driven to a non-zero value.

The amount of fuel delivered to the engine 110 during a cold start may be greater than the amount of fuel delivered to the engine 110 during normal operating conditions. As a result, pulsing the lift fuel pump 130 may be based on a temperature, such as fuel system temperature, engine temperature, and/or ambient temperature. For example, the duration of pulsing the lift fuel pump 130 may be shorter for colder ambient temperatures and longer for warmer ambient temperatures. Furthermore, the duty cycle of pulsing the lift fuel pump 130 may be based on the same temperature. For example, during an engine cold start more fuel may be delivered to the engine compared to normal operating conditions, and so the duty cycle may be increased for colder ambient temperatures such that more fuel is delivered to the engine during the pulsing of the lift fuel pump 130.

At 425, method 400 may include recording sensed fuel line pressure and fuel temperature upon detection of fuel vapor at the DI pump inlet 299. In one example, detecting fuel vapor at the DI pump inlet 299 may comprise detecting a drop in volumetric efficiency of the DI pump 140. In another example, detecting fuel vapor at the DI pump inlet 299 may comprise detecting a drop in pressure pulsations in the low-pressure fuel passage 154 as measured by pressure sensor 148. As described herein above with regard to FIG. 3, the fuel line pressure measured by pressure sensor 148 upon detection of fuel vapor may comprise vapor pressure. In this way, the fuel vapor pressure may be measured at a given temperature.

Upon cold start conditions, the fuel system 150 may be in thermal equilibrium such that the fuel system temperature is the same temperature throughout. Furthermore, initially after a cold start the fuel system 150 may be considered isothermal. Thus the measured fuel system pressure and temperature may be assumed constant and uniform throughout the fuel system 150. As a result, measuring the fuel temperature may comprise measuring a temperature of the vehicle system at a location other than the low-pressure fuel passage 154, including but not limited to turbine outlet temperature (TOT), engine coolant temperature (ECT), air charge temperature (ACT), manifold charging temperature (MCT), throttle charge temperature (TCT), cylinder head temperature (CHT), ambient air temperature (AAT), engine oil temperature (EOT), fuel rail temperature (FRT), and so on. However, in some examples the fuel system 150 may not be thermally uniform. In such examples, since the vapor pressure is set by the hottest point in the fuel system 150, typically understood as the DI pump inlet 299, the temperature sensed by temperature sensor 138 in the low-pressure fuel passage 154 may be measured and associated with the recorded vapor pressure.

After recording the fuel line pressure and temperature, method 400 may continue to 430. At 430, method 400 may include pulsing the lift pump 130 to restore fuel line pressure.

At 435, method 400 may include determining if the fuel temperature is above a threshold. The threshold may be selected such that a fuel temperature above the threshold indicates that the engine 110 has reached normal operating conditions (i.e., non-cold start conditions). If the fuel temperature is below the threshold, method 400 may return to 425 in order to obtain an additional ordered pair of vapor pressure and temperature. During engine warm-up, the fuel temperature gradually increases, and an ordered pair of vapor pressure and temperature may be obtained during each loop through steps 425 and 430 until the engine is fully warmed up.

If the fuel temperature is above the threshold, method 400 may continue to 440. At 440, method 400 may include determining a Reid vapor pressure (RVP) from the recorded fuel line pressure and fuel temperature measurements. RVP is defined as the vapor pressure of a fuel at a reference temperature (specifically, 100 degrees Fahrenheit).

In some examples, the RVP may be directly determined from a specific vapor pressure measurement obtained at 425, for example, if the vapor pressure is measured at a temperature of 100 degrees Fahrenheit. In other examples, determining the RVP may comprise calculating constants of the Antoine or August equations from the recorded fuel line pressure and fuel temperature measurements. For example, the fuel vapor pressure may be expressed in terms of the Antoine equation as $$\log_{10} p = A - \frac{B}{C+T},$$

where p is vapor pressure, T is temperature, and A, B, and C are constants that characterize the specific fuel under consideration. The August equation is a simplified form of the Antoine equation obtained by setting C equal to zero, or $$\log_{10} p = A - \frac{B}{T}.$$

As an illustrative example, FIG. 5 shows a graph 500 of example vapor pressure and temperature measurements obtained using the techniques described herein. In particular, graph 500 depicts a plot of the logarithm of pressure as a function of the reciprocal of temperature. Specifically, graph 500 includes a collection of data points 507 and a linear model 515 of the data points 507. The data points 507 represent ordered pairs of vapor pressure and temperature obtained, for example at 425. The linear model 515 may be obtained using, for example, a linear regression technique such as a least squares method. The constants A and B of the August equation may be determined from the slope and offset of the linear model 515. Thus controller 170 may process the obtained data points 507 using a linear regression method to determine August parameters A and B. Controller 170 may then determine the RVP from the constants A and B using, for example, a look-up table stored in non-transitory memory. In this way, the RVP may be extrapolated or interpolated from the measured vapor pressure and temperature data.

Returning to FIG. 4, method 400 may proceed to 445 after determining the RVP. At 445, method 400 may include determining a fuel composition from the recorded fuel line pressure and fuel temperature measurements. In particular, the fuel composition may be determine from the August parameters A and B as the parameters characterize a fuel, including the composition. In this way, the ethanol content of the fuel may be determined from the measured vapor pressure and temperature data.

At 450, method 400 may include updating one or more operating parameters based on the determined RVP and fuel composition. Subsequently executed control routines that depend on knowledge of fuel vapor pressure or fuel composition may utilize the obtained values to optimize vehicle control. For example, fuel vapor purge control routines may use the obtained value of fuel volatility (i.e., the RVP) to adjust an amount of vapor purging. As another example, fuel injection control routines may use the obtained RVP to adjust a fuel injection amount. Air-fuel ratio control methods and ignition timing control methods may further depend on the ethanol content (i.e., the fuel composition) as ethanol content is favorable for reducing spark retard at high loads with GDI injection. Method 400 may then end.

FIG. 6 shows an example timeline 600 for measuring fuel vapor pressure and temperature using the method described herein and with regards to FIG. 4. Timeline 600 includes plot 605, indicating the time since key-off over time. Line 607 represents a threshold for a time since key-off. Timeline 600 also includes plot 610, indicating the engine status over time; plot 615, indicating the fuel temperature over time; plot 620, indicating the lift pump voltage over time; and plot 625, indicating the fuel line pressure over time.

At time $T_0$, the engine is off, as shown by plot 615. The time since-key off is thus increasing towards a time threshold $T_t$, as shown by plot 605 and line 607. In one embodiment, the time threshold $T_t$ depicted by line 607 may represent an amount of time since key-off for the entire vehicle system, including the fuel system, to become isothermal. In this way, an engine cold start may be identified if the time since key-off is greater than the threshold $T_t$. In another embodiment, one or more vehicle system temperatures, such as engine coolant temperature and/or fuel system temperature, may be evaluated to identify an engine cold start.

At time $T_1$, the engine status changes from off to on, as shown by plot 610. As shown by plot 605, the time since key-off is above the threshold $T_t$ shown by line 607, indicating an engine cold start. In response to the engine turning on, the time since key-off counter resets to zero.

Responsive to the engine cold start conditions, after time $T_1$ the controller 170 controls the lift fuel pump 130 using a pulsed control method as described herein above with regard to FIG. 4. In particular, the lift pump voltage provided to the lift pump 130 comprises a series of temporally brief voltage pulses as depicted by plot 620. During each voltage pulse, the fuel line pressure (i.e., the pressure measured by pressure sensor 148 in the low-pressure fuel passage) increases as depicted by plot 525. The fuel temperature (i.e., the temperature measured by temperature sensor 138 in the low-pressure fuel passage) gradually increases while the engine warms up, as indicated by plot 515. As shown by plots 520 and 515, the lift pump voltage during each pulse may increase based on the fuel temperature.

In one example embodiment, a limit cycle is defined where fuel vapor is detected and the lift pump is pulsed to eliminate fuel vapor. Shortening the limit cycle increases the data rate. The limit cycle is shortened by making the lift pump pulses short in duration or small in voltage. Alternatively, the fuel system may pulse the lift pump with the objective to raise the lift pump pressure to near the pressure relief point (set by pressure relief valve 155) to minimize the number of limit cycles.

The controller 170 may record the fuel line pressure and corresponding fuel temperature prior to each lift pump voltage pulse, as the fuel line pressure corresponds to a vapor pressure at the corresponding fuel temperature as discussed herein above. The collection of vapor pressure and temperature measurements obtained may then be used to determine the fuel volatility and/or the fuel composition as described herein above. Eventually, the fuel temperature reaches a threshold (not shown), whereupon the lift pump voltage pulsing depicted by plot 520 may cease while normal operating control methods may be utilized to control the lift pump.

As described herein, in one example configuration, a method is provided for controlling operation of a vehicle via a controller in combination with various sensors and actuators, as well as other vehicle components, including during an engine start after the engine has been off for at least a minimum duration, actively controlling fuel pressure in a fuel system to a vapor-liquid volume ratio greater than zero and then recording sensed fuel pressure and temperature in the fuel system. In one example, the method includes performing the active control only after the engine has been off for at least the minimum duration, otherwise, not performing the active control of the fuel pressure and then recording.

In one example, actively controlling the fuel pressure comprises pulsing a fuel pump. In some examples, the fuel pump comprises a lift fuel pump, or low-pressure fuel pump.

In another example, recording the sensed fuel pressure and temperature is performed responsive to a detection of fuel vapor. For example, the detection of fuel vapor comprises sensing a decrease in volumetric efficiency of the fuel pump. As another example, the detection of fuel vapor comprises sensing a decrease in pressure pulsations in the fuel line near the fuel pump, for example as measured by a pressure sensor in the low-pressure fuel passage. In some examples, the method further comprises actively controlling the fuel pressure after recording and in response to the sensed fuel pressure and temperature. This method allows and may therefore include the characterization of a fluid's vapor versus temperature curve. Vapor pressure data points are taken over a range of fuel temperatures. Fuel temperature can be either measured or inferred. Since this data set can be inconvenient to handle, the data may be reduced to a two-parameter characteristic by fitting the data to the August equation. For some purposes, it may be useful to further reduce this to simply a one-parameter characterization: RVP (fuel vapor pressure at 100° F.).

In one example, the method further comprises determining fuel volatility based on the recorded sensed fuel pressure and temperature, and adjusting engine operation during subsequent engine combustion conditions based on the determined fuel volatility via an engine controller. In another example, the method further comprises determining fuel composition based on the recorded sensed fuel pressure and temperature, and adjusting engine operation during subsequent engine combustion conditions based on the determined fuel composition via an engine controller.

Due to the engine cold start conditions, the temperature through the vehicle may be considered substantially uniform during the engine cold start. The temperature uncertainty is the lowest at this condition. Furthermore, the vehicle, and the fuel system in particular, may be considered isothermal during the engine warm-up. In this way, the temperature at the hottest point in contact with the fuel, and thus the temperature that sets the vapor pressure, may be measured and/or inferred at a location independent of the proximity to the hottest point in contact with the fuel. Thus, in some examples, recording the sensed fuel temperature comprises recording a sensed temperature comprising at least one of a fuel system temperature, turbine outlet temperature, engine coolant temperature, air charge temperature, manifold charging temperature, throttle charge temperature, cylinder head temperature, ambient air temperature, engine oil temperature, and fuel rail temperature.

Furthermore, as described herein, in another example configuration, a fuel system for an engine comprises a fuel tank containing fuel, a fuel pump positioned within the fuel tank and configured to pump the fuel to one or more fuel injectors coupled to the engine, a temperature sensor coupled to a fuel passage connecting the fuel pump to the one or more fuel injectors, and a pressure sensor coupled to the fuel passage. The system further comprises a controller configured with instructions stored in non-transitory memory, that when executed, cause the controller to actively control fuel pressure in the fuel passage during an engine start after the engine has been off for at least a minimum duration, and record a sensed temperature from the temperature sensor and a sensed pressure from the pressure sensor.

In one example, actively controlling the fuel pressure comprises pulsing the fuel pump to drive the fuel pressure to a vapor-liquid volume ratio greater than zero. In some examples, the fuel pump is pulsed responsive to a detection of fuel vapor. In one example, the detection of fuel vapor comprises sensing a decrease in volumetric efficiency of the fuel pump. In another example, the detection of fuel vapor comprises sensing a decrease in pressure pulsations in the low-pressure fuel passage.

In another example, the controller is further configured with instructions that when executed cause the controller to calculate a fuel volatility based on the recorded temperature and the recorded pressure. In yet another example, the controller is further configured with instructions that when executed cause the controller to determine a fuel composition based on the recorded temperature and the recorded pressure. In another example, the controller is further configured with instructions that when executed cause the controller to update one or more control routines based on the recorded temperature and the recorded pressure.

As described herein, in yet another example configuration, a method comprises pulsing a fuel pump responsive to an engine cold start, and determining a fuel vapor pressure versus temperature characteristic based on fuel pressure and temperature while the fuel pump is being pulsed in response to a reduction in DI pump volumetric efficiency. In one example, a duration of pulsing the fuel pump is based on a temperature sensed prior to pulsing. The method further comprises, via an engine controller, adjusting engine fuel injection based on the determined fuel vapor pressure versus temperature characteristic during engine combustion operation, the engine controller further pulsing the fuel pump and including instructions to determine the fuel vapor pressure versus temperature characteristic based on sensed fuel pressure and temperature.

In one example, a duty cycle of pulsing the fuel pump is adjusted based on a temperature sensed immediately prior to pulsing. In another example, the method further comprises determining a fuel volatility based on the fuel pressure and temperature. The method further comprises, via an engine controller, adjusting one or more engine control methods based on the fuel volatility.

In one example, the engine cold start comprises an engine turning on after the engine has been off for at least a minimum duration. In another example, the engine cold start comprises an engine turning on when the engine and fuel system are in thermal equilibrium and below a temperature threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

during an engine start after an engine has been off for at least a minimum duration, actively controlling fuel pressure in a fuel system to a vapor-liquid volume ratio greater than zero and then recording sensed fuel pressure and temperature in the fuel system, wherein actively controlling the fuel pressure comprises pulsing a fuel pump positioned within a fuel tank.

2. The method of claim 1, wherein recording the sensed fuel pressure and temperature is performed responsive to a detection of fuel vapor.

3. The method of claim 2, wherein the detection of fuel vapor comprises sensing a decrease in volumetric efficiency of the fuel pump.

4. The method of claim 2, further comprising actively controlling the fuel pressure after recording and in response to the sensed fuel pressure and temperature.

5. The method of claim 1, further comprising determining fuel volatility based on the recorded sensed fuel pressure and temperature, and adjusting engine operation during subsequent engine combustion conditions based on the determined fuel volatility via an engine controller.

6. The method of claim 1, further comprising determining fuel composition based on the recorded sensed fuel pressure and temperature, and adjusting engine operation during subsequent engine combustion conditions based on the determined fuel composition via an engine controller.

7. The method of claim 1, wherein recording the sensed fuel temperature comprises recording a sensed temperature comprising at least one of a fuel system temperature, turbine outlet temperature, engine coolant temperature, air charge temperature, manifold charging temperature, throttle charge temperature, cylinder head temperature, ambient air temperature, engine oil temperature, and fuel rail temperature.

8. A fuel system for an engine, comprising:

a fuel tank containing fuel;

a fuel pump positioned within the fuel tank and configured to pump the fuel to one or more fuel injectors coupled to the engine;

a temperature sensor coupled to a fuel passage connecting the fuel pump to the one or more fuel injectors;

a pressure sensor coupled to the fuel passage; and a controller configured with instructions stored in non-transitory memory, that when executed, cause the controller to:

actively control fuel pressure in the fuel passage during an engine start after the engine has been off for at least a minimum duration, wherein actively controlling the fuel pressure comprises pulsing the fuel pump to drive the fuel pressure to a vapor-liquid volume ratio greater than zero; and record a sensed temperature from the temperature sensor and a sensed pressure from the pressure sensor.

9. The fuel system of claim 8, wherein the fuel pump is pulsed responsive to a detection of fuel vapor.

10. The fuel system of claim 9, wherein the detection of fuel vapor comprises sensing a decrease in volumetric efficiency of the fuel pump.

11. The fuel system of claim 8, wherein the controller is further configured with instructions that when executed cause the controller to calculate a fuel volatility based on the recorded temperature and the recorded pressure.

12. The fuel system of claim 8, wherein the controller is further configured with instructions that when executed cause the controller to determine a fuel composition based on the recorded temperature and the recorded pressure.

13. The fuel system of claim 8, wherein the controller is further configured with instructions that when executed cause the controller to update one or more control routines based on the recorded temperature and the recorded pressure.

14. A method, comprising:

pulsing a fuel pump responsive to an engine cold start, the fuel pump positioned within a fuel tank; and determining a fuel vapor pressure versus temperature characteristic based on fuel pressure and temperature while the fuel pump is being pulsed in response to a reduction in volumetric efficiency of the fuel pump.

15. The method of claim 14, wherein a duration of pulsing the fuel pump is based on a temperature sensed prior to pulsing, the method further comprising, via an engine controller, adjusting engine fuel injection based on the determined fuel vapor pressure versus temperature characteristic during engine combustion operation, the engine controller further pulsing the fuel pump and including instructions to determine the fuel vapor pressure versus temperature characteristic based on sensed fuel pressure and temperature.

16. The method of claim 14, wherein a duty cycle of pulsing the fuel pump is adjusted based on a temperature sensed immediately prior to pulsing.

17. The method of claim 14, further comprising determining a fuel volatility based on the fuel vapor pressure versus temperature characteristic.

18. The method of claim 14, wherein the engine cold start comprises an engine turning on after the engine has been off for at least a minimum duration.

* * * * *